US006615951B1

(12) United States Patent
Boutin et al.

(10) Patent No.: US 6,615,951 B1
(45) Date of Patent: Sep. 9, 2003

(54) ABSORBENT MATERIAL, CONSISTING OF A POROUS SUBSTANCE WITH DOUBLE POROSITY

(75) Inventors: Claude Boutin, Lyons (FR); Xavier Olny, Vaulx Milieu (FR)

(73) Assignee: Centre National de la Recherche Scientifique (C.N.R.S.), Paris Cedex (FR)

( * ) Notice: Subject to any disclaimer, the term of this patent is extended or adjusted under 35 U.S.C. 154(b) by 0 days.

(21) Appl. No.: 09/958,665

(22) PCT Filed: Apr. 10, 2000

(86) PCT No.: PCT/FR00/00912

§ 371 (c)(1),
(2), (4) Date: Dec. 10, 2001

(87) PCT Pub. No.: WO00/61888

PCT Pub. Date: Oct. 19, 2000

(30) Foreign Application Priority Data

Apr. 13, 1999 (FR) ..... 99 04603

(51) Int. Cl.[7] ..... E04B 1/92
(52) U.S. Cl. ..... 181/293
(58) Field of Search ..... 181/193, 190, 181/191, 192, 194, 195, 293

(56) References Cited

U.S. PATENT DOCUMENTS 4,113,053 A * 9/1978 Matsumoto et al. ..... 181/284
6,035,965 A * 3/2000 Fujiwara et al. ..... 181/286

FOREIGN PATENT DOCUMENTS

| | | |
|---|---|---|
| DE | 520 833 | 2/1931 |
| DE | 24 41 164 | 3/1976 |
| DE | 33 39 701 | 5/1985 |

* cited by examiner

*Primary Examiner*—Kimberly Lockett

(57) ABSTRACT

The invention concerns an absorbent material (1), consisting of a porous matter with open porosity (2), characterised in that it comprises a plurality of perforations (3) with varied transverse cross-section end positioned at an angle θ relative to a specific dimension of the material, thereby providing additional porosity (Pa) to the material (1).

5 Claims, 4 Drawing Sheets

ABSORBENT MATERIAL, CONSISTING OF A POROUS SUBSTANCE WITH DOUBLE POROSITY

The present invention relates to an improvement made to materials for acoustic and phonic absorption.

It relates more particularly to absorbent porous materials intended for buildings (wall coverings) and civil engineering installations (anti-noise devices), for which improvements in product performance are desired, in particular in terms of absorption coefficient, especially with respect to a specific frequency band.

Elements that absorb sound waves are often used for improving the acoustic conditions of noisy environments.

The sound waves, on encountering a material, depending on their properties, are generally partly reflected, diffracted, transmitted through the materials and absorbed.

By virtue of their properties, so-called acoustic absorbent materials limit the proportion of energy that is reflected.

Furthermore, the acoustic absorption of this material is also a function of the sensitivity, in terms of frequency response, of the receiving organ, which in the case of the human ear is between 20 and 20000 Hz. Generally it is difficult to find materials capable of treating the entire spectrum of the audible range, and in particular, the absorption of low frequencies, below 400 Hz, is very limited.

In the field of acoustic absorption, intended for industry or for domestic applications, materials are used which have the form of panels or of pulverulent products that are applied by spraying, and which are based on mineral glass wool, foam, fabric or alternatively of perforated rigid panels. In this last embodiment, reference may be made to Japanese patent JP10-175263, which describes an absorbent material formed of a sandwich consisting principally of a first layer of material provided with a plurality of holes that end in a plurality of cavities formed in a second layer backing onto the first. However, this absorbent material functions according to the Helmholtz principle, the energy of the sound waves being dissipated in the cavities.

These absorbent materials are selected according to their intended application (theatres or cinemas, conference halls, swimming baths, gymnasiums, dining halls, industrial environment etc.), their acoustic characteristics (frequency response), as well as their mechanical properties, fire resistance, heat absorption, rotproof properties etc.

These absorbent materials can be employed for exterior application as well as in a confined setting (interior application).

Thus, depending on the type of application, we are led to use for example mineral wools and certain foams with open porosity (a material is said to have open porosity when its pores are connected to one another and to the exterior) of low density or of higher density, and in this case they are used in applications for acoustic correction of ceilings or false ceilings (suspended ceilings) rather than in insulation of traditional walls.

Generally these products based on glass wool or foam possess suitable absorption properties, but they have three types of drawbacks:

- they are usually relatively fragile and therefore of poor endurance, in particular on account of the low densities employed bearing in mind that we wish to obtain relatively high permeability and porosity, and this low mechanical strength makes them difficult to install;
- their acoustic performance declines rapidly in the low frequency range (below 500 Hz), this effect being accentuated when these materials are made into thin panels;
- installation of those materials as false ceilings makes it possible to obtain acceptable acoustic performance, but requires having a large air gap to guarantee the acoustic performance.

An acoustic absorption material formed from a porous inorganic substance and comprising a plurality of perforations positioned at an angle of less than 80° relative to a specific dimension of the material is known from U.S. Pat. No. 4,113,053. Moreover, these perforations have a cross-section (square, circular or rectangular) that is of an area that can reach several tens of $mm^2$.

In addition, a soundproofing panel consisting of fibres and having a plurality of perorations arranged on its surface at an angle between 10° and 80° is known from German Patent DE 33 39 701. Moreover, the cross-section of these perforations can be chosen arbitrarily.

The present invention therefore aims to overcome these drawbacks, by proposing improvements made to the acoustic materials that, endow them with good mechanical properties (mechanical strength), even when these materials have small thickness, while preserving their excellent acoustic absorption properties, especially in the low-frequency range.

To this end, the acoustic absorbent material, consisting of a porous substance with open porosity, having a plurality of perforations positioned at an angle θ relative to a dimension consisting of the thickness of the material, thus imparting as additional porosity (Pa) to the material that is the object of the invention, is characterized in that the additional porosity (Pa) ranges from 10 to 30% and in that it has an acoustic absorption coefficient ranging from approx. 0.7 to 0.93 for low frequencies, in particular of the order of 300 Hz.

Other characteristics and advantages of the present invention will become clear from the description given below, referring to the appended drawings which illustrate an example of application thereof, which is in no way limiting. In the drawings.

Figure 1:
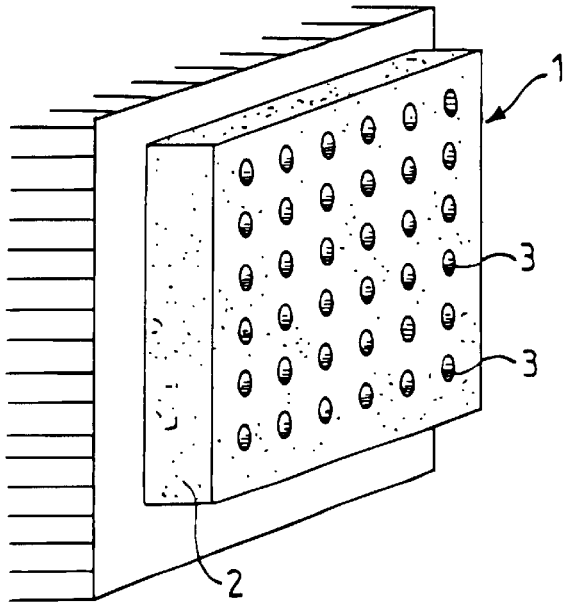
FIG. 1 is a perspective view of an absorbent material according to a first embodiment of the invention.
Figure 2:
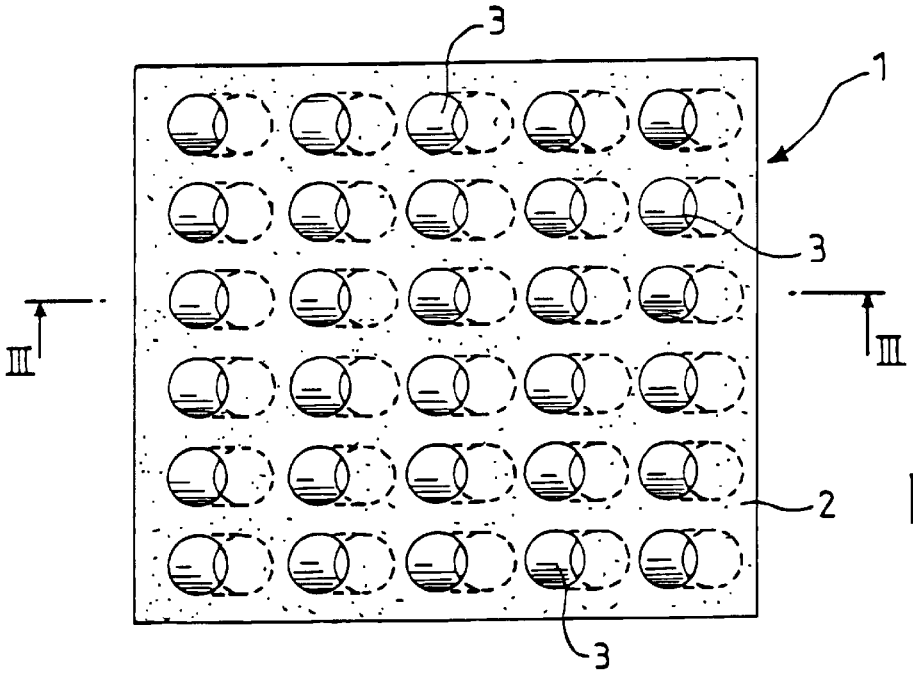
FIG. 2 is a sectional plan view of FIG. 1.
Figure 3:
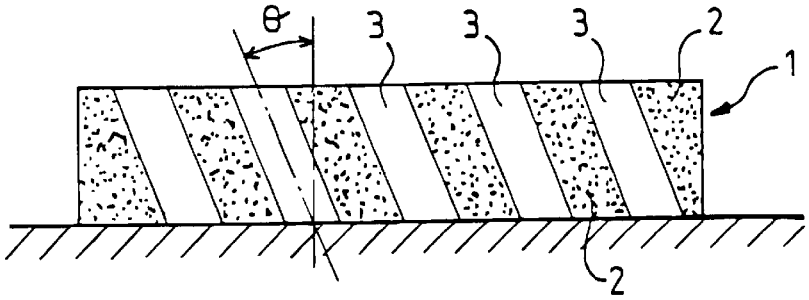
FIG. 3 is a sectional, lateral elevation of FIG. 2.
Figure 4:
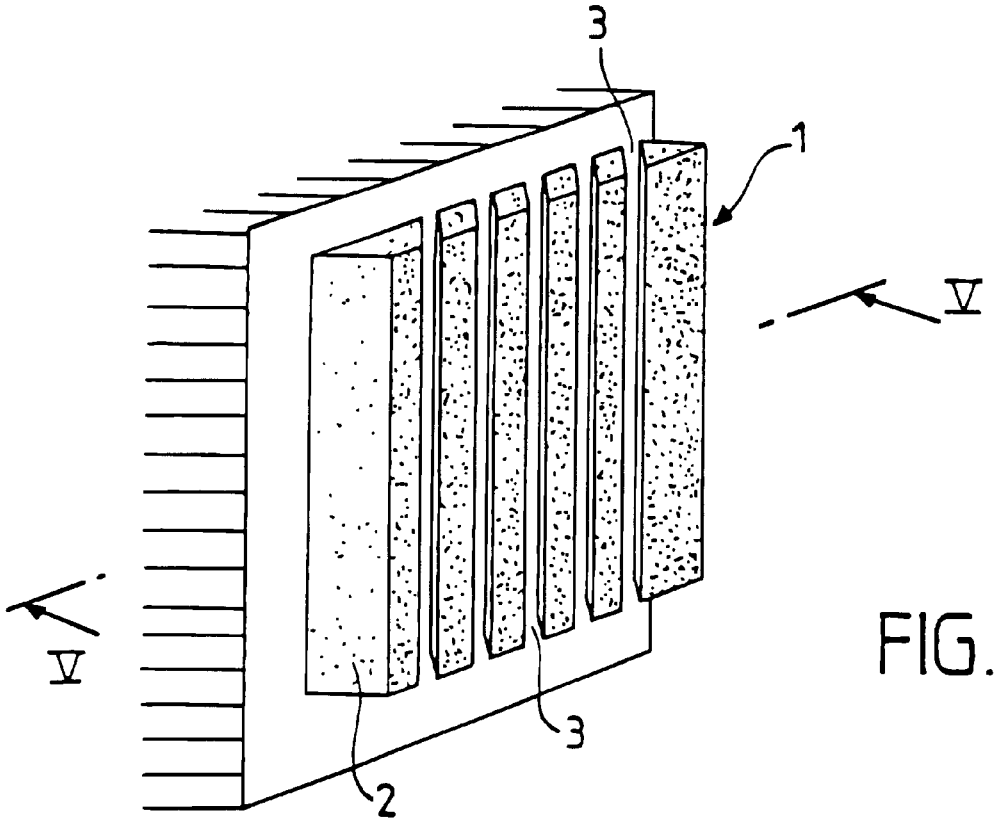
FIG. 4 is a perspective view of an absorbent material according to a second embodiment of the invention.
Figure 5:
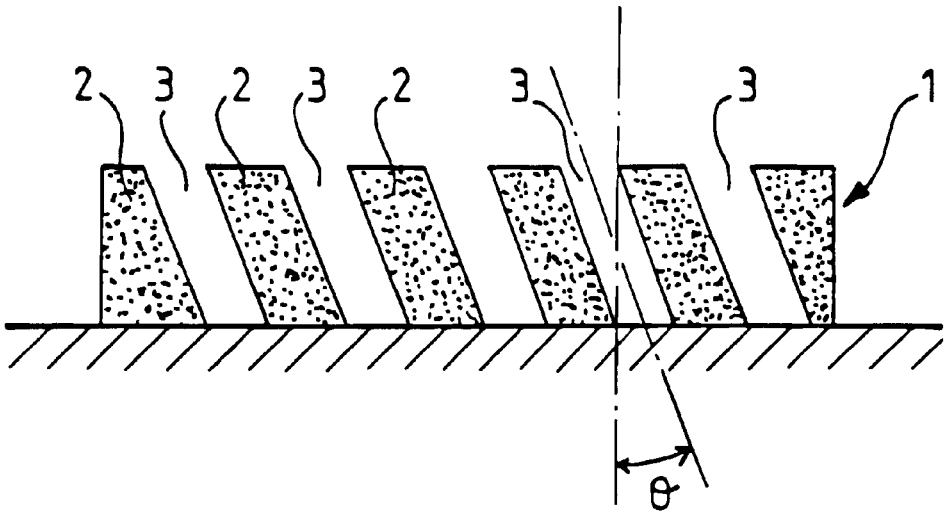
FIG. 5 is a sectional, lateral elevation of FIG. 4.

According to a preferred embodiment, reference may be made to FIGS. 1 and 4 which illustrate two different embodiments of the acoustic material, the latter comprising a base material represented by reference 1 in the drawings.

This material is fabricated, in a non-limiting manner, in the form of panels or boards of suitable dimensions such that they can be manipulated easily by a single user.

According to one characteristic of the invention, this material is porous and possesses open porosity (open porosity is defined thus the pores are connected to one another and to the exterior).

For example, a material based on mineral wool, mineral-fibre concrete, wood or synthetics, or more generally based on foams, exhibits this property. Traditionally, the size of the pores (denoted by reference 2 in FIGS. 1 and 4) is less than a millimetre.

Thus, when a sound wave enters a porous medium of this kind, the air trapped within the pores of the material is caused to vibrate, giving rise to inertial and thermal viscous effects which dissipate a proportion of the energy.

The flow of air within this material and absorption of the corresponding acoustic wave across this material are functions of the dynamic permeability and of the frequency of the wave.

For its part, the dynamic permeability of this material is a function of the geometric characteristics of the material and by altering the geometry of panel 1 we affect the absorption factors of an acoustic wave passing through it.

Thus, according to another advantageous characteristic of the invention, a plurality of additional perforations 3 are made in panel 1.

The said additional perforations have a cross-section of very varied profile (circle, oval, square, rectangular or triangular etc.) and extend sight through according to one of the principal dimensions of the panel (in particular over the thickness or over the length) or as a variant, these perforations do not open cut and are therefore blind in that case.

In addition, according to another characteristic of the invention, inclination of the axis of these perforations at an angle θ in the range 0 to 50° is envisaged.

Similarly, the specific dimension of the perforation: its diameter in the case of a circle, its width in the case of a rectangular slot—can vary in a range between approx. 0.005 and 0.1 m.

According to yet another characteristic of the invention, it is possible to determine the porosity added to the single-porosity material by means of the aforementioned parameters (inclination and/or choice of specific dimension of the perforation), according to the following equation where Pa represents the additional porosity which is defined as follows, it being the ratio of the volume of the cylinders to the total volume of the panel.

We shall assume that the panel has an area of 1 $m^2$, and in this case, $$Pa=n\times\pi\times(d/2)^3/\cos(\sigma)$$

n is the number of perforations per $m^2$
d is the specific dimension in metres
θ is the inclination of the perforation.

By varying these three parameters simultaneously, or one after another, it is possible to effect an accurate determination of the acoustic behaviour of such a panel and in particular to establish its frequency response.

Figure 6:
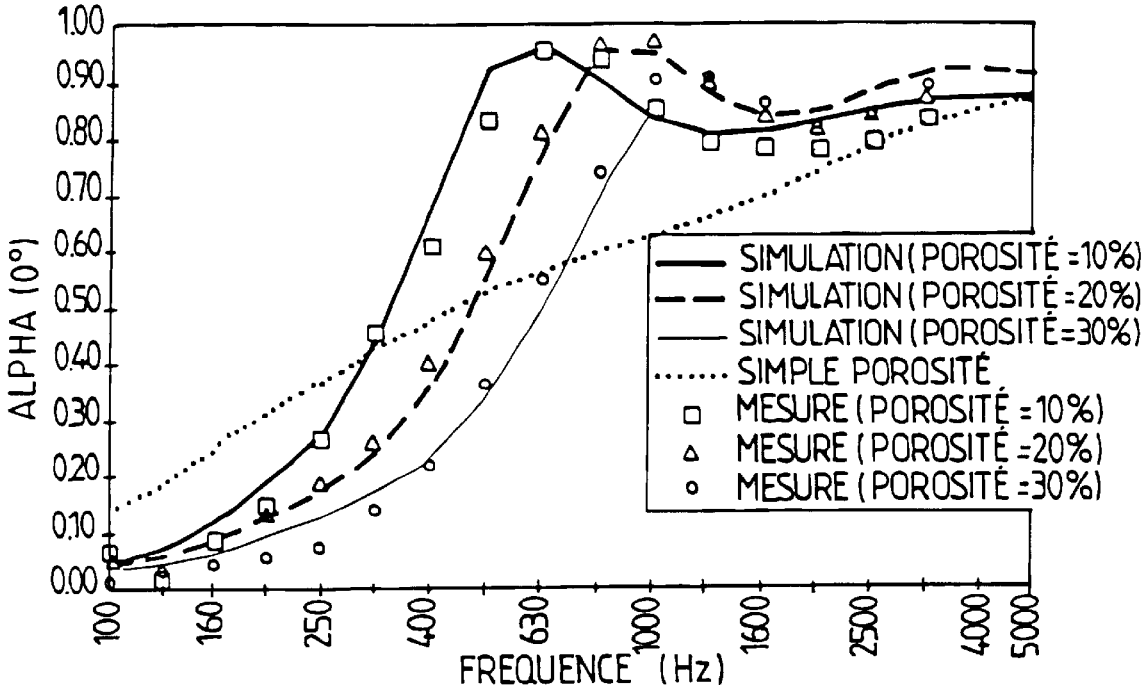
FIG. 6 is a graph showing the variation of the absorption coefficient of the panel according to the invention, for different frequency values according to different porosities.
Figure 7:
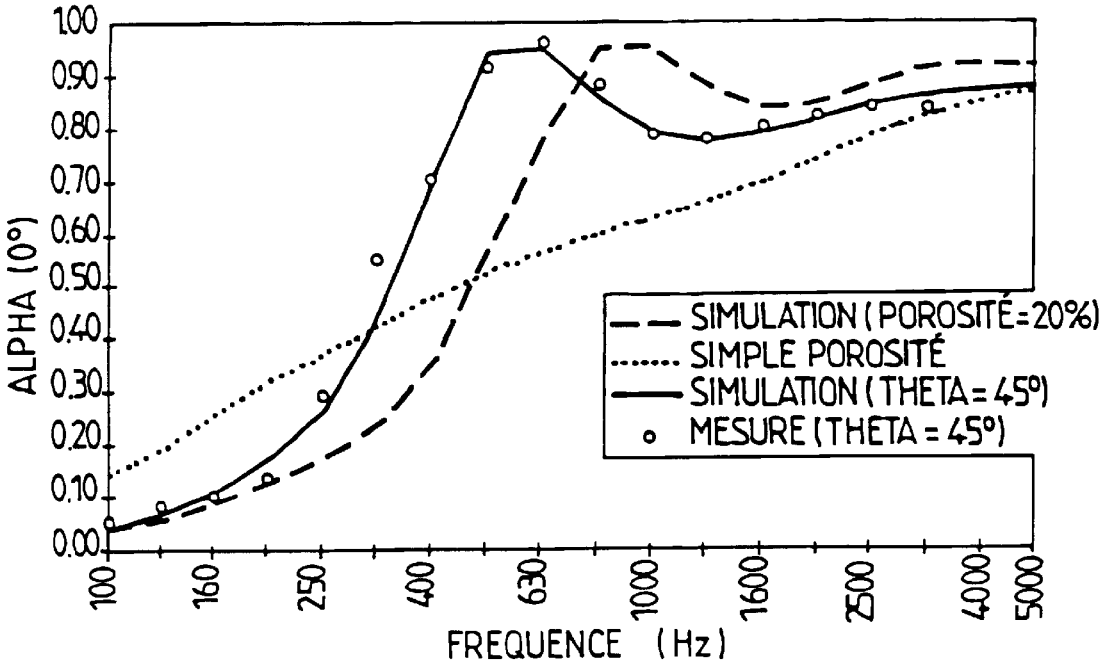
FIG. 7 is a graph showing the variation of the absorption coefficient of the panel according to the invention, for different frequency values according to different values of the angle of inclination θ.
Figure 8:
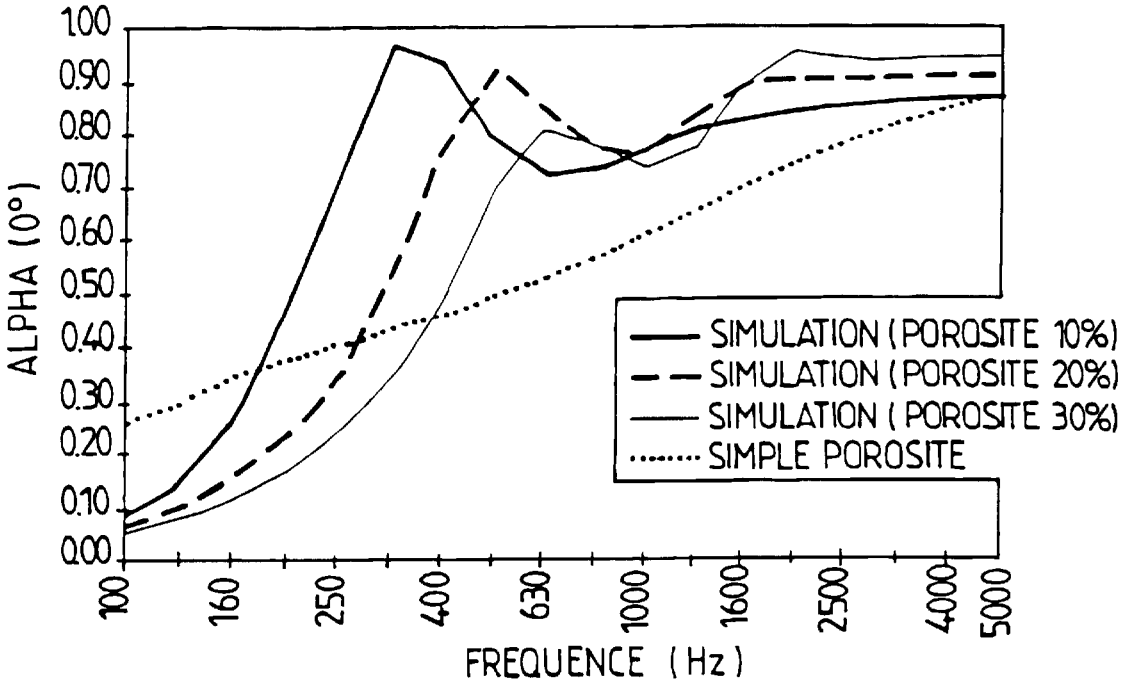
FIG. 8 is a graph showing the variation of the absorption coefficient of the panel according to the invention, for different frequency values according to different values of the additional porosity.

As an example, refer to FIGS. 6, 7 and 8, which show, for various configurations of panels, the variation of the double-porosity panel according to the invention relative to a single-porosity panel which belongs to the prior art.

It is important to note that a double-porosity panel according to the invention possesses absorption coefficients that are far higher than those of the panels of the prior art (cf. FIGS. 6, 7 and 8), this absorption coefficient being between approx. 0.8 and 0.95 for frequency values between 400 and 600 Hz for FIGS. 6 and 7 and close to the range 225–350 Hz in FIG. 8.

Examination of these various graphs shows perfectly that it is possible to adjust the cutoff frequency of the material to a value close to the sensitivity of the human ear (below 300 Hz).

In addition, it can be seen that a small additional porosity, of the order of 10%, contributes to a large increase in the absorption coefficient in the vicinity of 300 Hz.

On the other hand, the greater this additional porosity (of the order of 30% or even 40%), the more this increase in absorption coefficient is shifted towards medium frequency values (of the order of 500 Hz). Of course, this increase in additional porosity is achieved at the expense of the mechanical characteristics of the panel; it is therefore clear that the choice of the constituent parameters of the panel according to the invention is an optimum compromise between the desired absorption coefficient, the cutoff frequency, and the mechanical strength of the panel.

The invention as described above offers many advantages as it can be applied starting from single-porosity panels known in the prior art, the best results in terms of absorption coefficient being obtained for relatively low porosity values, which is preferable when we wish to have the benefit of high mechanical strength, ensuring great ease of application and long-lasting results.

Of coarse, these calculations make it possible to control the frequency response of the material for the desired absorption coefficient and are moreover easier to apply using special simulation software which gives excellent results in relation to experimental measurements (cf. FIGS. 6, 7, 8).

According to one characteristic of the invention, the additional porosity (Pa) of the absorbent material (1) is in the range from 10 to 30%.

According to another characteristic of the invention, the absorption coefficient ranges from approx. 0.7to 0.95 for low frequencies, in particular of the order of 300 Hz.

Of course, the present invention is not limited to the examples of application described and represented above, but includes all variants.

What is claimed is:

1. Acoustic absorbent material (1), consisting of porous substance with open porosity (2), having a plurality of perforations (3) positioned at an angle σ relative to a dimension consisting of the thickness of the material, thus imparting an additional porosity (Pa) to the material (1), characterized in that the, additional porosity (Pa) is in the range from 10 to 30% and in that it has an acoustic absorption coefficient that ranges from approx. 0.7 to 0.95 for low frequencies, of the order of 300 Hz.

2. Absorbent material (1) according to claim 1, characterized in that the perforations (3) have a circular cross-section.

3. Absorbent material (1) according to claim 1, characterized in that the perforations (3) have a rectangular cross-section.

4. Absorbent material (1) according to claim 1, characterized in that the angle of inclination (θ) of the perforations (3) is in the range from 0 to 50°.

5. Absorbent material (1) according to claim 1, characterized in that the specific dimension of a perforation (3) is in the range from 0.005 m to 0.1 m.

* * * * *